US007534139B2

(12) United States Patent
Andre et al.

(10) Patent No.: US 7,534,139 B2
(45) Date of Patent: May 19, 2009

(54) FLAT CABLE CONNECTORS FOR SEALED APPLICATIONS

(75) Inventors: Marcel Andre, Moissy Cramayel (FR); Jannik Armand, Lauterbourg (FR); Laurent Stickeir, Gif sur Yvette (FR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/581,895

(22) PCT Filed: Nov. 30, 2004

(86) PCT No.: PCT/EP2004/013584

§ 371 (c)(1),
(2), (4) Date: Mar. 14, 2007

(87) PCT Pub. No.: WO2005/055372

PCT Pub. Date: Jun. 16, 2005

(65) Prior Publication Data

US 2007/0264864 A1 Nov. 15, 2007

(30) Foreign Application Priority Data

Dec. 5, 2003 (DE) ..... 203 19 011 U

(51) Int. Cl.
*H01R 13/40* (2006.01)

(52) U.S. Cl. ..... 439/587; 439/271; 439/77; 439/519; 439/936

(58) Field of Classification Search ..... 439/587, 439/271, 277, 465, 584, 77, 936, 519
See application file for complete search history.

(56) References Cited

U.S. PATENT DOCUMENTS 3,333,229 A * 7/1967 Dean et al. ..... 439/417
4,601,528 A * 7/1986 Spier ..... 439/148
5,161,981 A * 11/1992 Deak et al. ..... 439/66
6,196,863 B1 3/2001 Schwant
2001/0023149 A1 9/2001 Muruyama
2002/0031934 A1 3/2002 Hara et al.
2002/0173199 A1 11/2002 Liegl et al.
2005/0020131 A1 * 1/2005 Beck et al. ..... 439/587

FOREIGN PATENT DOCUMENTS

DE 101 42 363 3/2003
DE 101 42 363 A1 3/2003
EP 0 722 624 B1 9/1998

* cited by examiner

*Primary Examiner*—Briggitte R Hammond
*Assistant Examiner*—Vanessa Girardi

(57) ABSTRACT

The invention relates to a flat cable connector for sealed applications. An object of the invention is to show a new and considerably improved kind of a flat cable connector for sealed applications, compared to the current state of the art. The invention proposes a connector (100) for a sealed connection of a flat cable arrangement (200), with an external housing (101), with an insertion opening (103) for the insertion of the flat cable arrangement (200), with at least one sealing element (107, 108, 107', 108', 107", 108") comprising compressed gel, which can be so arranged at the connecting point of the insertion opening (103) for the flat cable arrangement, that it only comes into effective contact with the flat cable arrangement (200) when the flat cable arrangement (200) is in an inserted condition and with a device (110, 107*a*, 108*a*, 107*b*, 108*b*, 120, 121, 122, 130, 120) for the pressurization of the at least one sealing element (107, 108, 107', 108', 107", 108") for sealing at least the connecting point when the flat cable arrangement is in inserted state.

14 Claims, 12 Drawing Sheets

FLAT CABLE CONNECTORS FOR SEALED APPLICATIONS

AREA OF THE INVENTION

The invention relates to flat cable connectors for sealed applications.

PRIOR ART

In countless applications, flat cables, e.g. flex foils, flat ribbon cables, flexible printed circuit boards, extruded or laminated flat cables are connected to plug-type or socket connectors. In doing so, the individual conductors are traditionally first equipped with terminals, e.g. by soldering or crimping which are in turn connected to corresponding terminal contacts or with terminal position assurance means (TPA) inside the connector to be connected.

In order to seal these terminal connecting points from external influences, e.g. against water splashes, or mechanical damage, a variety of different techniques are known that are in some case, however, fraught with considerable disadvantages.

On the one hand, the connecting points can be molded. This, however, does not generally result in clean connections meaning that no real seal is achieved. If the connection areas are first pre-etched and then molded, any subsequent repair may not be possible. Finally this encapsulating technique is technically difficult and time consuming and consequentially expensive and besides this commonly cannot be effected in an environmentally-friendly way and specific protective measures have to be taken into consideration.

Solid seals used in the connector housing generally always leave non-tight conductor peripheral areas and/or enable insertion of the flat cable arrangement into the inside of the connector only to a limited degree due to lack of space, especially in the case of connectors that are of necessity small or tiny.

One of the objects of the invention will therefore be to demonstrate a new and considerably improved way of designing a flat cable connector for sealed applications compared to the current state of the art, using which it is possible to effectively combat the problems outlined above.

SUMMARY OF THE INVENTION

Surprisingly, the inventive solution of the problem is provided by a subject matter of one of the attached independent claims.

Advantageous and/or preferred refinements and embodiments are the subject of the sub-claims.

According to the present invention, a connector for a sealed connection of a flat cable arrangement, the connector having an external housing with an insertion opening for inserting the flat cable arrangement, is adapted for positioning at least one sealing element comprising compressed gel in a connecting point of the insertion opening in such a way that this only effectively contacts the flat cable arrangement when the flat cable is actually inserted, and a device is provided for applying pressure to the at least one sealing element for sealing at least the connecting point or area when the flat cable arrangement is inserted. Gel-based sealing elements according to the present invention practically are in the functional form of a simple cushion or pad made of compressed gel.

Fundamental benefits of the invention therefore are to be found in the fact that no or only very slight pressure need be applied when inserting the flat cable arrangement, since contact or penetration of the sealing elements on inserting the flat cable arrangement respectively the terminals connected to the conductors is avoided. Furthermore, this is beneficial in that the flat cable arrangement is not exposed to unintentional attack through the compressed sealing gel and hence especially the risk of damage is impossible.

The gel used as sealant also has the advantage that it can penetrate through to any desired point when pressurized and even cleanly seals edges, whereby the degree of hardness or viscosity can be preselected according to application—or component-specific requirements. This way it is, for example, possible to easily guarantee necessary protection against vibration and/or buckling as well as to ensure smooth transitions or smooth kink edges. In this way it is also possible to significantly influence the area reached by the initially compressed gel upon pressure being applied, meaning that it is not only possible to seal the connection area not only to the conductors but also to adjacent areas within the connector housing.

According to a preferred refinement, the connector comprises sealing elements, of which at least one comprises compressed gel, at the connection area on either side of the flat cable arrangement in such a way that given a suitable assembly, a strain relief can be ensured for the flat cable arrangement in its assembled condition. The flat cable arrangement comprises, for example, a flex foil, a flat ribbon cable, a flexible printed circuit board, an extruded cable or a laminated cable where, depending on the application, terminal contacts and/or terminal position assurance means (TPA) are arranged in the connecting point of the connector in such a way as to interact with terminals attached to the conductor ends of the flat cable arrangement. The connector according to the present invention is therefore suitable for a wide range of applications.

In addition, it is essentially possible to use any gel-based elastomer for the invention, especially a silicon gel as a particularly media-resistant material, for example inside motor vehicles. At the same time, it is possible to specifically use the selected gel as a dielectric. Based on this gel and depending on the application, it is therefore possible using the invention to achieve not only a simple protection against water splashes, but also to protect against pressurized water, both at positive pressure and at negative pressure, and penetration of air, gas, fluids or aggressive substances even gasoline, for example. Due to the dielectric qualities, it is also possible to bring about increased protection against breakdown, especially for bare areas, an adjustment of impedance, especially in the case of HF (HIGH FREQUENCY) applications and/or an adjustment of the reflection attenuation.

Furthermore, in the course of a practical development, especially for a simple and quick (pre-)assembly, it is provided that the at least one sealing element and the pressurization device interacting with it can be moved between at least one position that essentially leaves the insertion opening clear up to the connecting point and another position that essentially closes the insertion opening. This also provides further protection against environmental influences.

In order to guarantee repairs to the connector that may become necessary, the pressurization device is fixed in the position that essentially closes the insertion opening preferably using snapping, catching or locking means allocated to the pressurization device. Further catching means can be set aside for intermediate positions, for example, for provide certain initial tensions during assembly or whenever repairs are carried out.

In a preferred embodiment, two sealing elements are moved by the pressurization device in a pincer or gripper like way towards the top and bottom of the flat cable arrangement into a position that essentially closes the insertion opening and are subjected to pressure. In order at the same time to exercise pressure on the sealing elements in normal as well as axial direction with the aim of achieving an essentially regular formation of the gel seal, it is provided in a further development a connector being designed with guiding means extending in the insertion direction of the flat cable arrangement diagonally from above and below of the flat cable arrangement in direction to the flat cable arrangement, in order to bring about the simultaneous guidance of the pressurization device both in a normal direction in relation to the flat cable arrangement as well as in an axial direction in relation to the flat cable arrangement.

In another especially preferred embodiment, the pressurization device with its allocated guiding and catching devices, is designed that a guiding of the pressurization device results first in a normal direction, in relation to the flat cable arrangement at the connecting points and then in an axial direction in relation to the flat cable arrangement at the connecting points, or vice versa. As a result it is possible to achieve a strain relief in advance for the flat cable arrangement, before the sealing process has been completed. Depending on the application it is in addition possible to guarantee with this kind of guiding that the flat cable arrangement, when fully assembled, in relation to its insertion direction projects essentially at an angle between +90° and −90° out of the connector housing, which means that straight or angled flat cable connections can be realized.

In yet another preferred embodiment, following the insertion of the flat cable arrangement, the sealing elements and the pressurization device can be inserted into the insertion opening of the connector, so that this embodiment is e.g. especially suitable for even the smallest connectors. In the course of further functional development it is also provided a one-piece pressurization device designed with a slot essentially corresponding to the cross-section of the flat cable arrangement, through which the flat cable arrangement will be led out of the connector housing. But in principle other designs of the pressurization device can also be used for this purpose, especially a one-piece design with two elastically connected halves or a two-piece design.

To reduce the number of connector components, a cover for the connector housing closing the insertion opening is preferably provided as being a component of the pressurization device.

If the flat cable connector according to the invention has at least one hole opening leading outwards through the connector housing at the point of at least one sealing element comprising compressed gel, an outwardly visible indication of the sealing achieved during the sealing process can be guaranteed, e.g. by means of visual examination of the extent to which the pressurized gel has already entered the hole opening. Once the sealing process has been completed the indicator opening will as a result also have been sealed.

The flat cable connector according to the invention practically comprises a jack or plug connector mating end for mating a counter connector.

Thus a preferred connector system manufactured according to the present invention, e.g. also a pre-assembled connector system suitable to further use, comprises at least one above-mentioned described connector with a flat cable arrangement connected to it and with at least two pressurized sealing elements mounted on each side of the flat cable arrangement at the connecting area, with at least one of the sealing elements being made out of compressed gel. Such connector systems also can be arranged one behind another in a modular alignment.

In the following the invention is described in more detail on the basis of preferred embodiments with reference to the attached drawings.

DETAILED DESCRIPTION OF PREFERRED EMBODIMENTS

Figure 1:
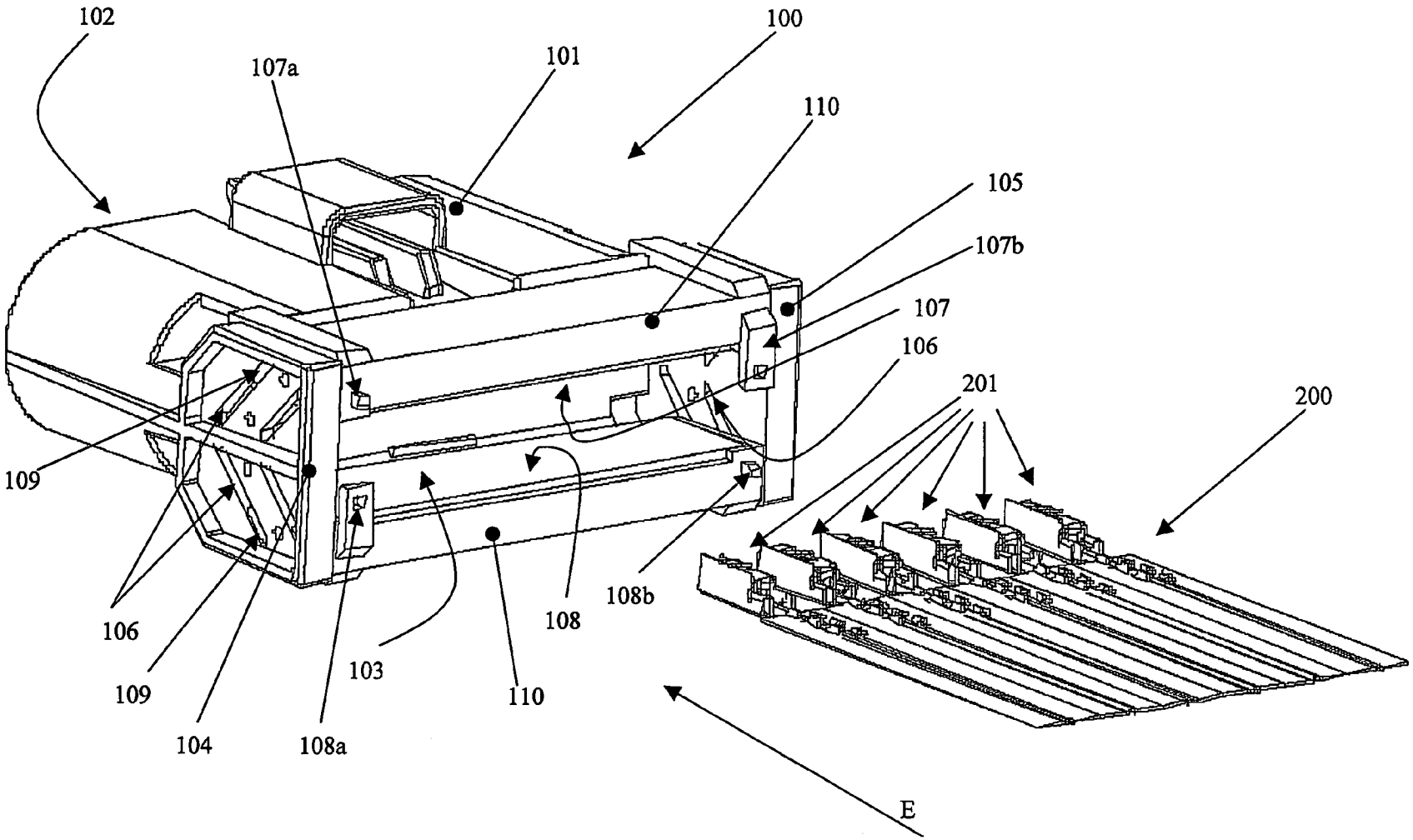
FIG. 1 a first design of a flat cable connector according to the invention, with the flat cable connector and the flex foil in an unassembled condition, FIG. 2 the flat cable connector according to FIG. 1, but with an inserted, but not yet sealed flat cable arrangement, FIG. 3 the flat cable connector according to FIG. 1 with a completely inserted and sealed flat cable arrangement, FIG. 4 a second design of a flat cable connector represented in an exploded view in an unassembled condition, FIG. 5*a* and 5*b* the flat cable connector according to FIG. 4 in a pre-assembled condition without inserted flat cable arrangement, FIG. 6*a* and 6*b* the flat cable arrangement according to FIG. 4 with inserted, but not yet sealed flat cable arrangement, FIG. 7 the flat cable connector according to FIG. 4 with completely inserted and fixed flat cable arrangement, FIG. 8 the flat cable connector according to FIG. 4 with completely inserted, fixed and completely sealed flat cable arrangement, FIG. 9 a third design of a flat cable connector represented in an exploded view in unassembled condition, FIG. 10 the flat cable connector according to FIG. 9 in pre-assembled condition with inserted flat cable arrangement, FIG. 11 the flat cable connector according to FIG. 9 with inserted flat cable arrangement and inserted sealing elements, and FIG. 12 the flat cable arrangement according to FIG. 9 in assembled condition.

For the following description of preferred, but purely exemplary embodiments, it should first be noted that essentially the same components or those with equivalent properties are represented in the drawings with the same reference signs.

Figure 2:
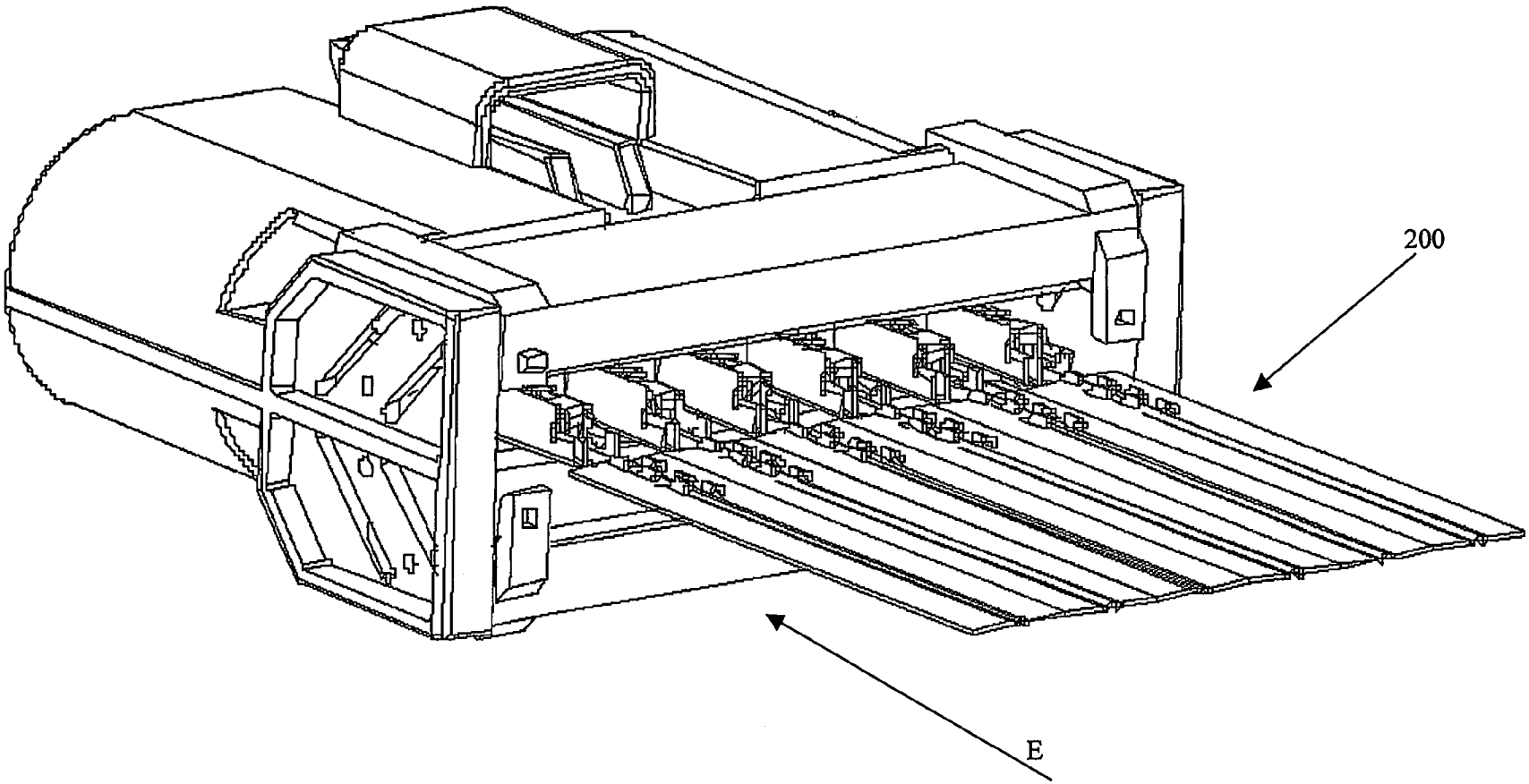
Figure 3:
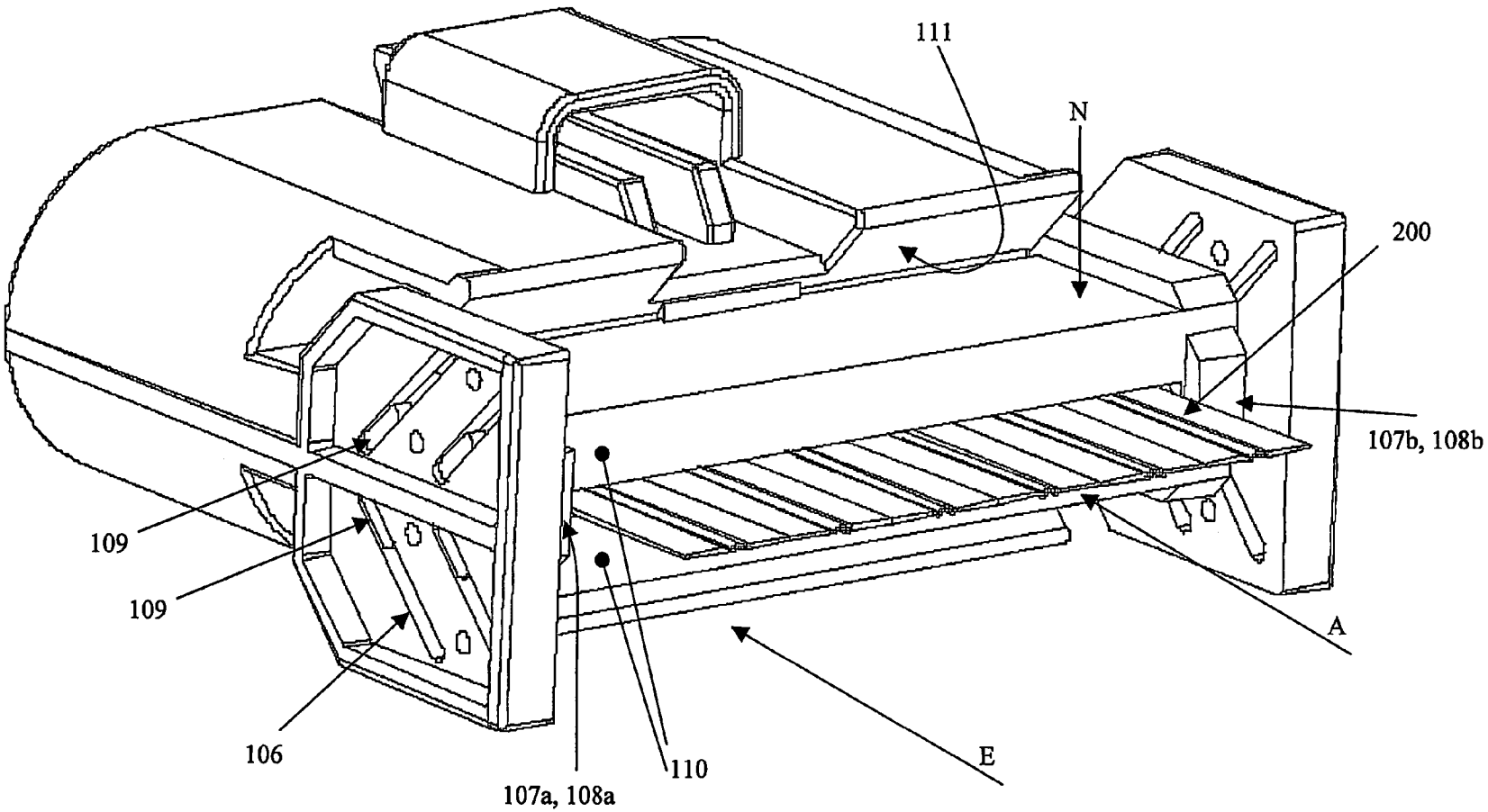

FIGS. 1 to 3 represent a simplified view of a first embodiment according to the invention of a flat cable connector in different successive assembling stages, embodying a pressurization device, i.e. a device for applying pressure, with which two sealing elements are moved pincer like in direction of the upper and lower side of the flat cable arrangement into a position essentially closing a flat cable insertion opening and are subjected to pressure.

In detail there is a representation of a flat cable connector, generally marked with 100 with a connector housing generally marked with 101. The connector 100 is engineered as a connector socket and as in FIG. 1 has a rear receptacle opening 102 for the reception of a complementarily designed counter-connector, but which is not shown. On the opposite side of the receptacle opening 102 as in FIG. 1 the flat cable connector 100 comprises a flat cable insertion opening to insert a flat cable arrangement 200 of a familiar variety.

An exemplary representation of a flat cable arrangement 200 as in FIG. 1 in the preferred form is designed as essentially being a flex foil, in particular comprising a flexible flat cable (FFC) or a flexible printed circuit (FPC). However, a flat cable capable of use according to the invention can comprise another flat ribbon cable, an extruded (flat) cable or a laminated (flat) cable. Hence fundamentally in the following description and in the claims the general term of a flat cable or a flat cable arrangement is used.

The flat cable arrangement 200 represented comprises in addition connecting leads or terminals 201 specific to the application, which are connected to the conductors of the flat cable e.g. by pressure, crimping, welding or also by (laser-) soldering technologies. The flat cable arrangement 200 as a whole is normally provided by a cable harness manufacturer prior to insertion in the connector in order to effect the electrical connection of the flat cable arrangement.

The housing 101 of the connector 100 is on principle sealed at transition or interface faces and depending on the application has at the connecting points or areas in the interior corresponding terminal contacts and/or terminal position assurance means (TPA), as it is known in general.

The flat cable insertion opening 103 has a larger and essentially rectangular cross-section, which is limited laterally as well as to the top and bottom, in relation to the flat cable arrangement 200 which must be inserted.

The lateral limitation is achieved by plate-formed frame elements 104 and 105, which are connected to the housing 101. Guiding grooves 106 are formed on the frame elements 104 and 105, e.g. by means of cutting or by the use of corresponding pre-formed parts during manufacture, each running in the insertion direction of the flat cable arrangement diagonally from the upper or lower area of the frame elements 104, 105 to the middle section of the frame elements 104, 105. Two pillow or cushion-like sealing elements 107 and 108 made out of a compressed gel are installed movably across and between the frame elements 104 and 105 and limit the flat cable insertion opening 103 at the top and bottom.

Assigned to the sealing elements 107 and 108 are guiding projections 109 extending in direction of the frame plates 104 and 105 up to the guiding grooves 106. Hence the sealing elements 107 and 108 can be moved along the guiding grooves 106 between a position opening the flat cable insertion opening 103 and a position closing the flat cable insertion opening 103, that is in the insertion direction E of the flat cable arrangement from the upper or lower area of the frame elements 104, 105 to the middle area of the frame elements 104, 105 and vice versa. Furthermore assigned to the sealing element 107 are snapping, catching or locking means 107*a* and 107*b* working in combination with complementary catching or locking means 108*a* and 108*b* assigned to the sealing element 108 to achieve catching or locking, when the sealing elements 107 and 108 are in the position closing the flat cable insertion opening 103.

The guiding projections 109 and the catching means 107*a*, 107*b*, 108*a* and 108*b* can be directly connected to the sealing elements 107 and 108. However, the guiding projections 109 and the catching or locking devices 107*a*, 107*b*, 108*a* and 108*b* are constructed in a preferred manner at respective cassette-shaped support devices 110, as in FIG. 1 to 3, in which the sealing elements 107 and 108 being insertable in such a way that the opposing surfaces of the sealing elements 107 and 108 project out of the support device 110.

As can be seen in FIG. 2, in the position of the sealing elements 107 and 108 unblocking the flat cable insertion opening 103, the flat cable arrangement 200 is inserted with the end providing the terminals 201 into the flat cable insertion opening 103 until the terminals are aligned at a predefined, not represented position within the flex foil connector, in accordance with the example described, at the terminal contacts or terminal position assurance means. Since the sealing elements 107 and 108 are here far apart, an unimpeded insertion of the flat cable arrangement 200 and in particular of the terminals 201 is ensured. The terminals 201 must in particular not penetrate through the sealing gel during insertion. Hence there is no danger that the compressed sealing gel has an effect on the flat cable arrangement prematurely or unintentionally or that particles of the sealing elements 107 and 108, for example as a result of friction, penetrate into terminals 201. Since in addition no or very little force is required for the insertion, the flat cable arrangement as a whole is not subjected to any damaging strain during insertion.

Following the insertion of the flat cable arrangement 200 there follows, as can be seen in FIG. 3, its sealing by moving the sealing elements 107 and 108 into the position closing the flat cable insertion opening 103. Due to the guidance means 106 and 109, especially the arrangement of the guiding grooves 106, only minimal force need be applied here, an undesired canting or displacement of the sealing elements is prevented and a pressurization of the gel-based sealing elements 107 and 108 to achieve sealing both in the normal (N) and axial (A) direction in relation to the flat cable arrangement 200 is guaranteed. To support the sequence of movements, housing walls 111 arranged behind the support constructions 110 have essentially the same angle of inclination as the guiding grooves 106. Once the sealing elements 107 and 108 have reached their final position, they are fixed in this by the interlocking of the locking means 107*a* and 108*a* or 107*b* and 108*b* and maintained by pressure in a functional manner.

Depending on the application it is particularly advantageous if the gel-based sealing elements are pre-selected, sized and arranged in the housing 101 with such a viscosity that the gel used for sealing in the sealing elements 107 and 108 during pressurization reaches from the terminals 201 at least as far as to the conductors of the flat cable 200 as well as to the predefined areas in the connector housing 101.

In addition different gels can be used depending on the application area, e.g. silicon gels, which are particularly media-resistant, but other gel-based elastomers as well. Sealing with gel has in particular the advantage that depending on the degree of firmness of the gel used it reaches virtually every cranny, creates no sharp edges and closes the open edges of a meniscus that may have been caused. In addition the gel sealant in accordance with the invention provides protection against vibration, anti-kink protection and soft kink edges as well as, if so selected, a certain strain relief. Depending on the gel selected, the flat cable connector is sealed against water splashes and pressurized water, both at excess and negative pressure, other fluids, including aggressive kinds, e.g. petrol, and/or air and correspondingly protected. Since the gel sealant is also a dielectric, based a suitable choice and the dimensions of the compressed gel used an adjustment depending on the application is attainable with regard to a desired protection against disruptive discharges, a desired impedance, especially in HF (HIGH FREQUENCY)-applications and/or a reflector attenuation.

If the connector housing has a hole opening leading outwards in the area of at least one of the gel sealing cushions, of such a kind that when the pressurized gel gets into the hole opening or an indicator agent is pressed outwards this can be seen from the outside, then this will in addition provide an indicator in relation to the spreading process of the gel produced by the pressurization and hence on the sealing achieved by the gel.

FIG. 4 to 8 show a further preferred embodiment of the invention as an example, which includes a pressurization device with guidance and catching means dedicated to it to guide the pressurization device, first in a normal direction in relation to the flat cable arrangement at the connecting point and then in an axial direction in relation to the flat cable arrangement at the connecting point.

Figure 4:
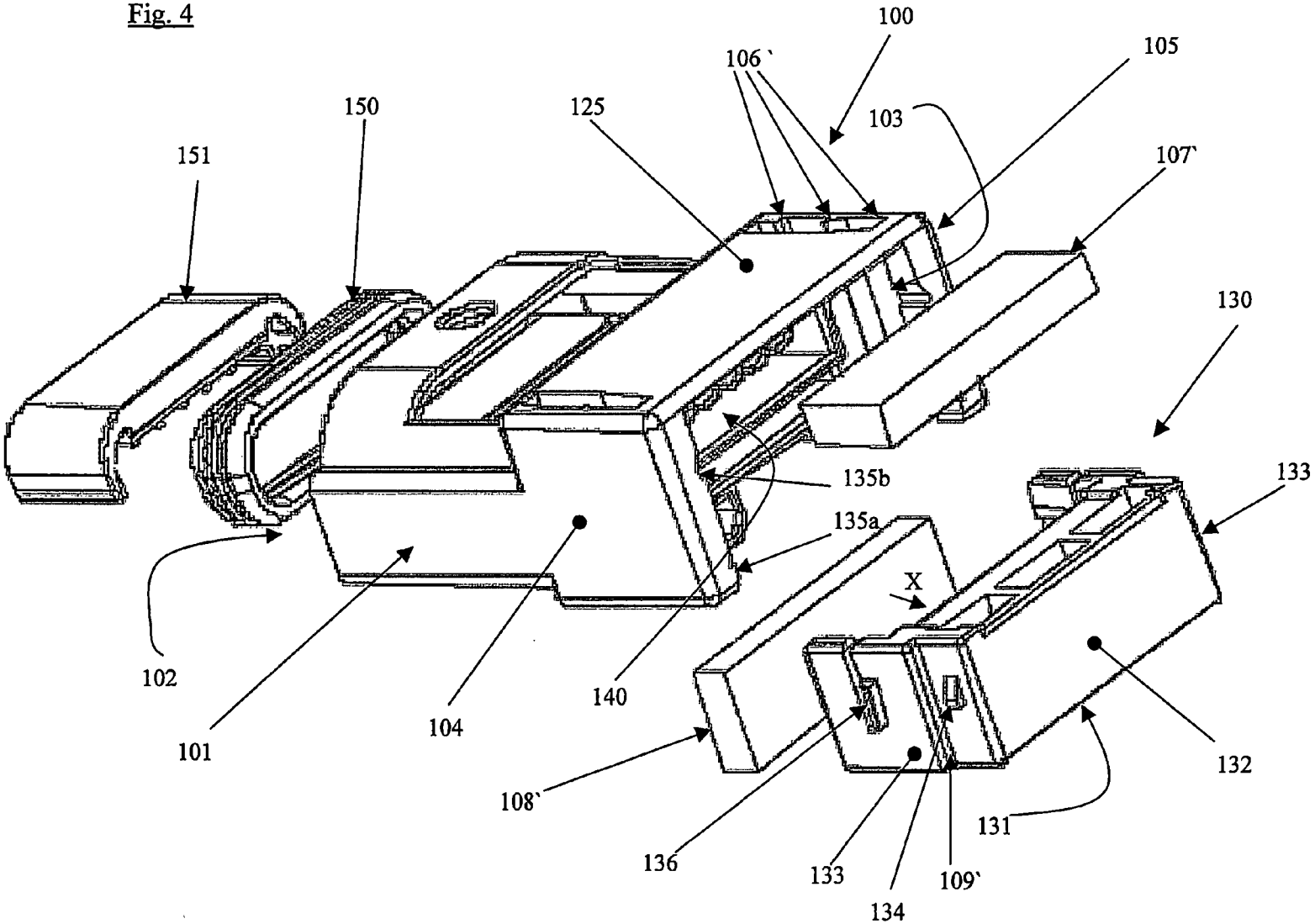
Figure 5B:
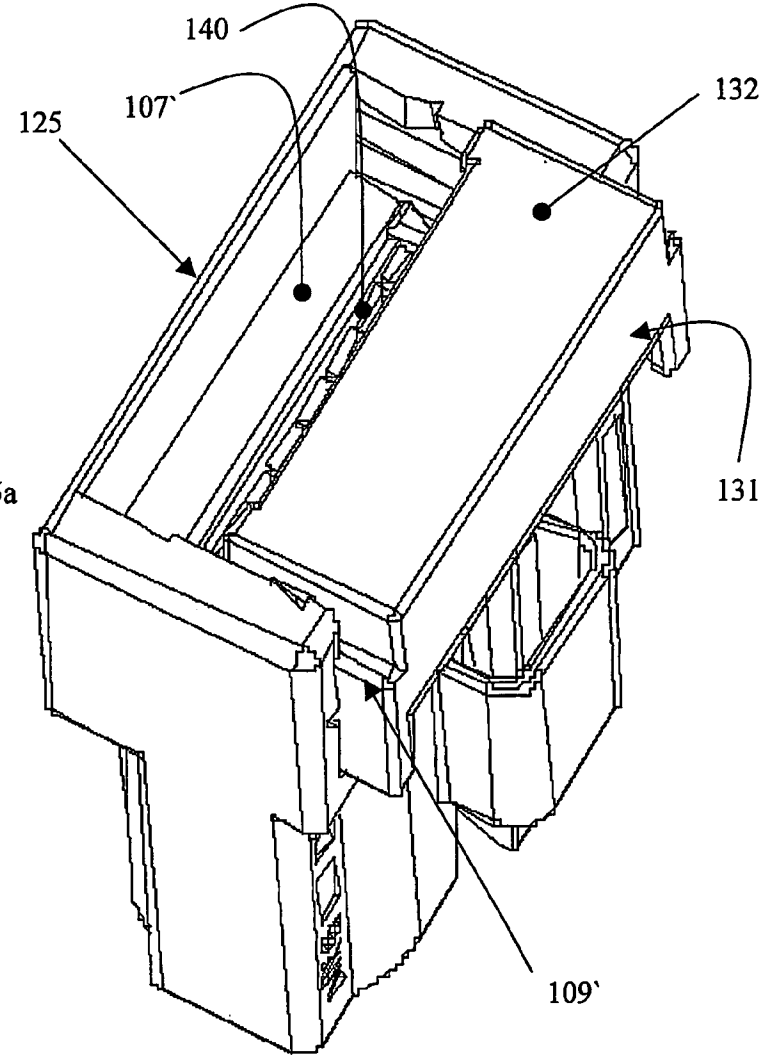
Figure 5A:
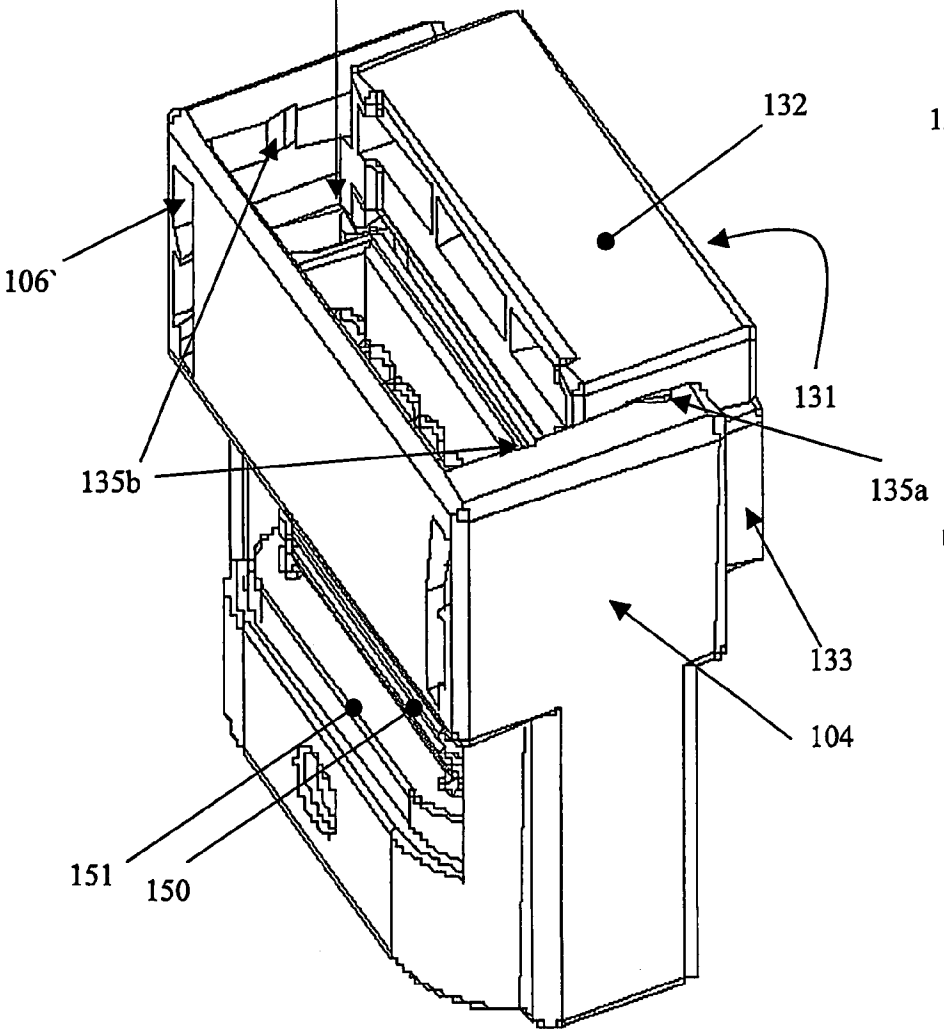
Figure 6B:
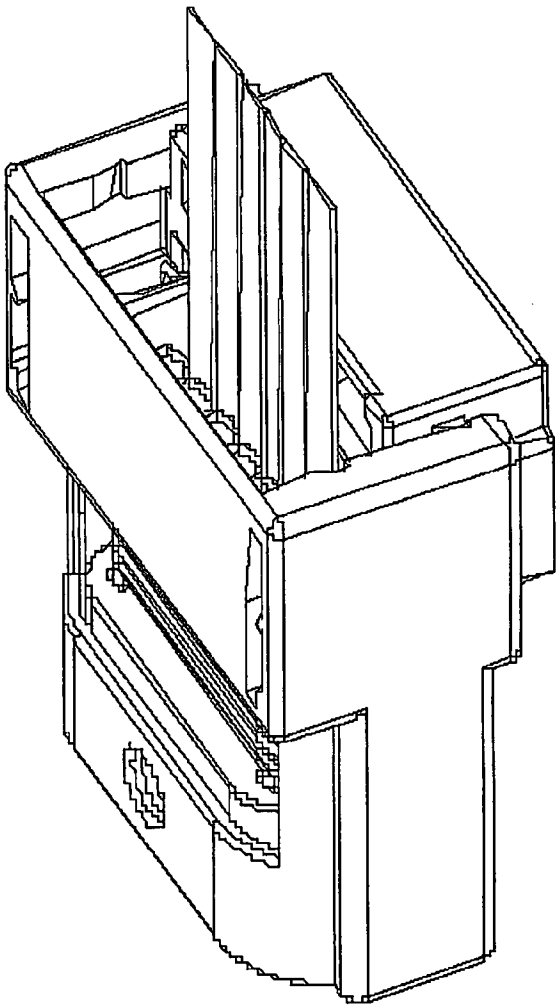
Figure 6A:
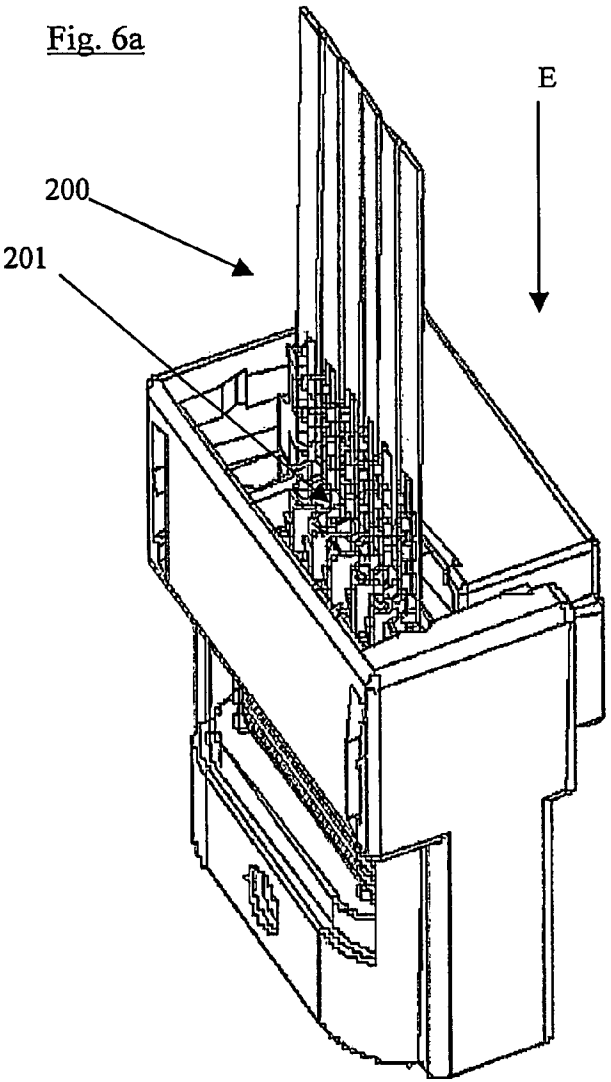

The flat cable connector 100 as in FIG. 4 to 8 in addition to the design as in FIG. 1 to 3 features a gasket sleeve 150 which can be inserted into the housing 101, as is particularly evident in FIGS. 4 and 5*a*, from the side of the receptacle opening 102 for receiving a complementarily shaped, but not represented counter plug connector. This gasket sleeve 150 is kept in housing 101 by the attachment clip 151 in the area of the terminal contacts in the housing for additional sealing.

In turn, the flat cable insertion opening 103 according to the embodiment of FIG. 4 to 8 has a larger and essentially rectangular cross-section in relation to the flex foil that has to be inserted.

Furthermore two plate-like frame elements 104 and 105 attached to the housing 101 and having guiding grooves or ribs 106' arranged therewith provide lateral limitation of the flat cable insertion opening 103; But in amendment to the first embodiment described, these guiding grooves or ribs 106' essentially run vertically to the insertion direction E (FIG. 5*a*) of a flat cable arrangement 200. One of the two remaining sides of the flat cable insertion opening 103, in F*ig*. 4 the left or upper side, is limited by a further plate-like frame element 125 connected to the housing 101 and/or to the plate-like frame elements 104 and 105. On the side opposite of the frame element 125 a cover 130 is inserted and guided, as hereafter described in more detail, to achieve sealing pressurization as well as to close the insertion opening 103 in assembled condition with the flat cable arrangement 200.

For this purpose the cover 130 has two frame elements 131 and 132, essentially arranged to each other at a right angle, whose longitudinal extension essentially corresponds to the inner distance of the frame elements 104 and 105. The frame element 132, for the purpose of the insertion of the cover 130, being aligned diagonally or at an angle to the insertion direction of the flat cable arrangement 200 and the frame element 131 essentially being aligned parallel to the insertion direction of the flexible foil 200 (FIG. 5*a, b*). The open side areas formed by the angled arrangement of the frame elements 131 and 132 are closed by two frame elements 133 which are connected essentially vertically at their long side ends with the frame elements 131 and 132. Hence the frame elements 133 limit the frame elements 131 and 132 in their longitudinal extent and are aligned parallel to the frame elements 104 and 105 and inserted between these to achieve the attachment of the cover 130. On the outer sides of the frame elements 131 and 132 guidance strips or ribs 109' and 136 are formed, which work in combination with the guidance tracks 106' during the insertion of the cover 130. Thus the cover 130, as can be seen in FIG. 4 to 8, is essentially inserted at first across the insertion direction of the flat cable arrangement in the housing 101 between the frame elements 104 and 105, that is, in a kind of upside down installed drawer without a back wall, and is guided in direction to the frame element 125.

Also in this embodiment two sealing elements 107' and 108' are used to seal a flat cable arrangement 200 connected with a flat cable connector 100. The sealing element 107' , as can be seen in particular in FIGS. 4 and 5*b*, is inserted into the insertion opening 103 between the frame element 125 and the terminal contacts or terminal position assurance means 140 arranged within connector 100 for the terminals 201 attached to the conductors of the flat cable and essentially completely fills this intermediate area. The sealing element 108' is inserted in the cover 130, as shown by the arrow X in FIG. 4, and thus routed together with the cover 130 in direction to the frame element 125, so that in the end there is a sealing element arranged on the upper and lower sides of the inserted flat cable arrangement at the connecting area. In this embodiment both sealing elements 107' and 108' are again preferably compressed gel cushions, though in this design it is in principle sufficient to provide only the sealing element 108' in gel form, since as will be hereafter described, no or very little pressure is exercised on sealing element 107' , so that in order to reduce costs resort could also be had to another sealant material.

Cover 130 in addition has catching or locking devices 134 on the frame elements 133 formed with guidance devices 109'. The catching or locking devices 134 interact with complementarily formed catching or locking devices 135*a* and 135*b* on the frame elements 104 and 105 to lock the cover in a first or second snap-in or locking position, as is described in detail below.

To install the flat cable connector 100 as in FIG. 4 to 8 with the flat cable arrangement 200 the two sealing elements 107' and 108' are first inserted in the insertion opening 103 or the cover 130. Then the cover is installed in a functional manner as in FIGS. 5*a* and 5*b* between the frame elements 104 and 105 and guided into the first snap-in or locking position. Then the flat cable arrangement 200 is inserted into the insertion opening 103 with its attached terminals 201 to the terminal contacts or terminal position assurance means 140 in the connector 100 (FIG. 6*a*, 6*b*). Hence in this embodiment an unimpeded insertion of the flat cable arrangement 200 and especially the terminals 201 in relation to the sealing elements 107' and 108' is also provided for.

Figure 7:
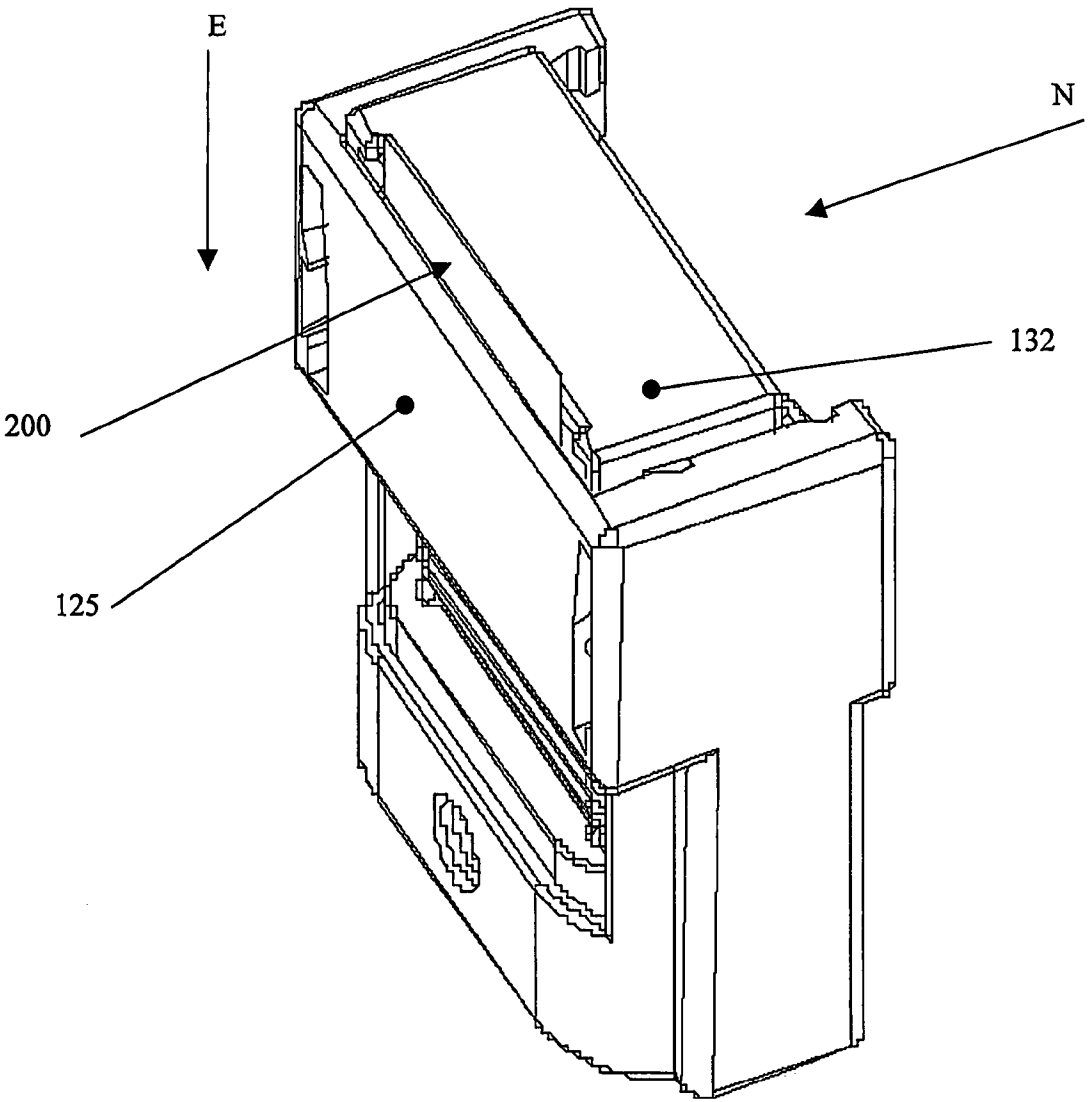
Figure 8:
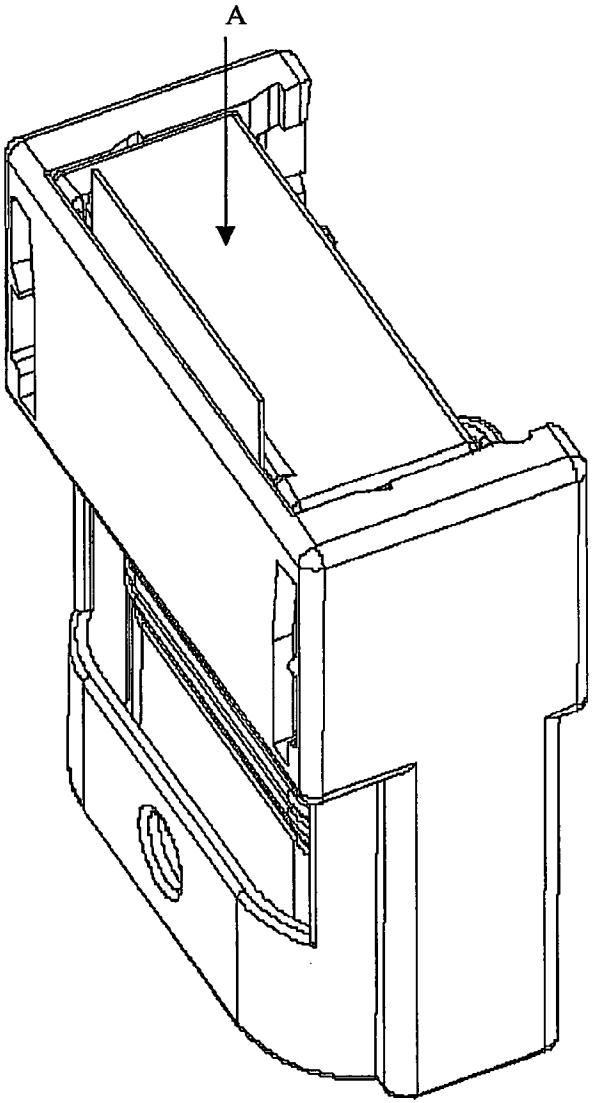
Figure 9:
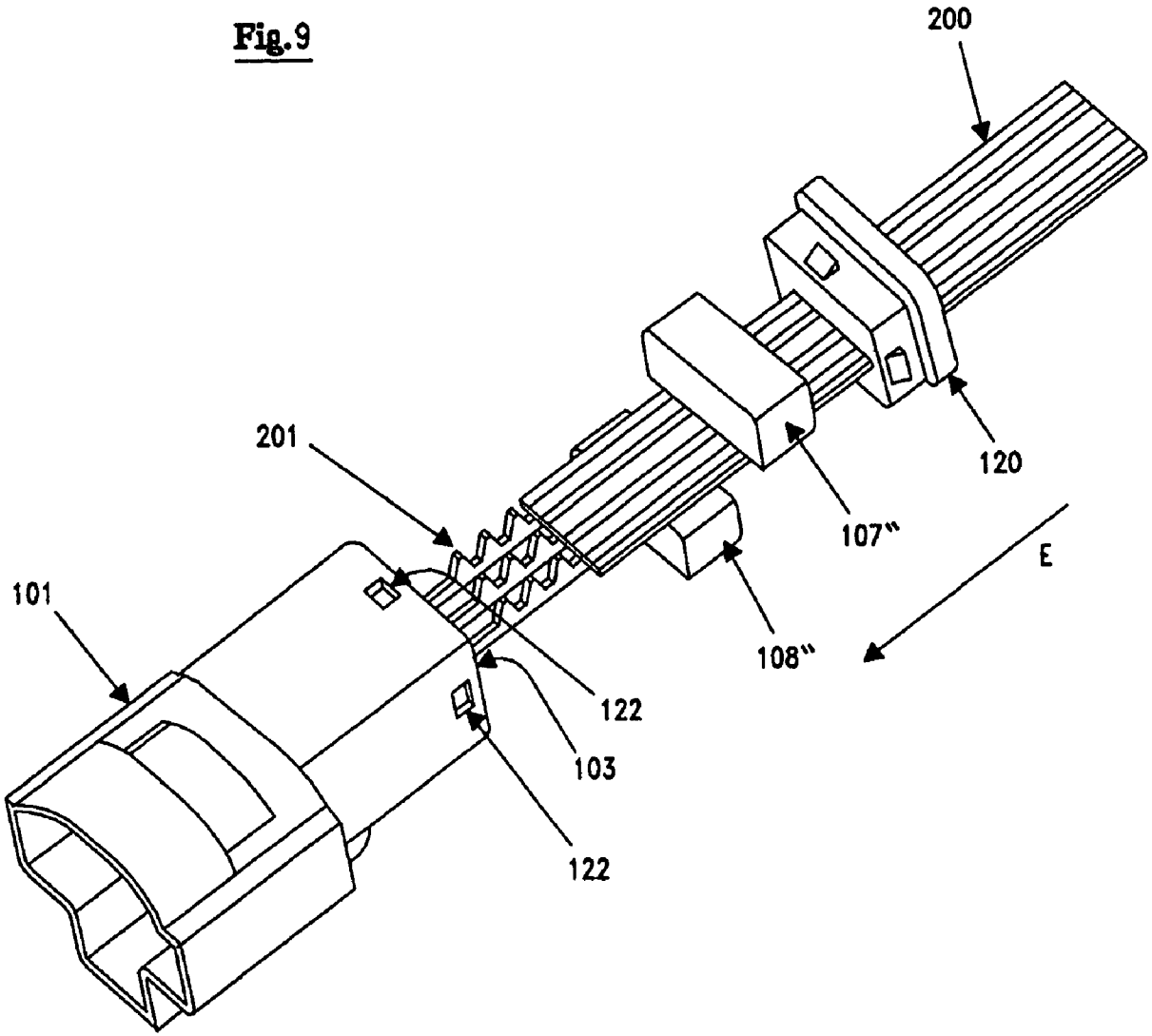

Hereafter the cover 130, as shown in FIG. 7, is guided further in direction to the frame element 125 up to the second snap-in or locking position, whereby in the embodiment shown the flat cable arrangement 200 is led via the sealing element 107' to the frame element 125 and thus in its final position projects outwards directly between the frame element 125 and the cover-frame element 132. This achieves a strain relief of the flat cable arrangement and through the cover 130 a pressurization on the gel-based sealing element 108' in relation to the flat cable arrangement in the normal direction N. After this the cover, as can be seen in FIG. 8, is guided into by light pressurization in the insertion direction of the flat cable arrangement into its final position, thereby completing the sealing of at least the connection area through axial pressurization A of the sealing element 108', and is preferably locked by further complementarily designed catching or locking means. For this purpose the ribs 136 arranged on the frame element 133 can in addition snatch behind one of the ribs 106' arranged on the inside of the frame elements 104 and 105 in order to fix the cover 130 closing the insertion opening.

It is worth pointing out that in modification to the embodiment shown in FIG. 4 to 8, depending on the application the cover and the sealing elements to be inserted can also be so designed, that the flat cable arrangement does not project straight out of the connector between the frame element 125 and the cover 130, but instead on the side, in particular essentially turned by 90°, that is, in relation to FIG. 5*b* for example, it projects below the frame element 131. Here it is preferable that the flat cable arrangement is inserted first and then the cover is installed on the connector housing in the first position. In this case depending on the application, an arrangement of the guidance and catching devices can also be provided for that first a displacement of the cover in an axial direction in relation to the insertion direction is carried out and then a displacement in the normal direction. Given a correspondingly mirrored design of the cover and the frame elements 104, 105 and 125 the extension of the flex foil 200 to the opposite side, that is with reference to FIG. 8 for example essentially in an angle of 90° to the left, also can be guaranteed.

The fundamental design of a cover that is positioned off-set to the insertion opening on the connector housing, which can then be successively moved in the insertion opening in a normal or axial direction, or vice versa, to achieve the corresponding pressurization of the sealing elements, thus enables a "straight" and an angled flat cable connector in combination with the sealing elements suitable inserted in the housing and cover.

The FIG. 9 to 12 show an example of another embodiment of a flat cable connector according to the invention, which has been realized with sealing elements and a pressurization device, which can inserted following the insertion of the flat cable arrangement in the insertion opening.

As can be seen in the first essential modifications with regard to the first embodiment as afore-described based on FIGS. 1 to 3, result from the fact that the gel-based sealing elements 107" and 108", designed in the form of pillows or cushions, are only arranged after a pre-assembly of the flat cable connector 100 as in FIGS. 9 to 12 with the flat cable arrangement 200 inside the flat cable connector 100 and/or the housing 101. In addition, to achieve a pressurization of the sealing elements 107" and 108" following their arrangement in the flat cable insertion opening 103, a cover 120 for pressurization is provided, which is connectable in the insertion direction E of the flat cable 200 with the wall of the flat cable insertion opening 103.

For this purpose the exterior dimensions of the opening cover 120 designed for pressurization are so sized that it can be inserted in direction of the insertion direction of the flat cable arrangement 200 at least partly into the flat cable insertion opening 103 and preferably here undergoes a sliding- or press fit with the flat cable insertion opening 103. Complementary catching or snapping devices 121 and 122 are constructed on the opening cover 120 and the wall of the flat cable insertion opening 103 to achieve the final fixation. In addition the opening cover 120 has a slot 123 essentially corresponding to the cross-section of the flat cable arrangement 200, through which the flat cable arrangement 200 is led.

Figure 10:
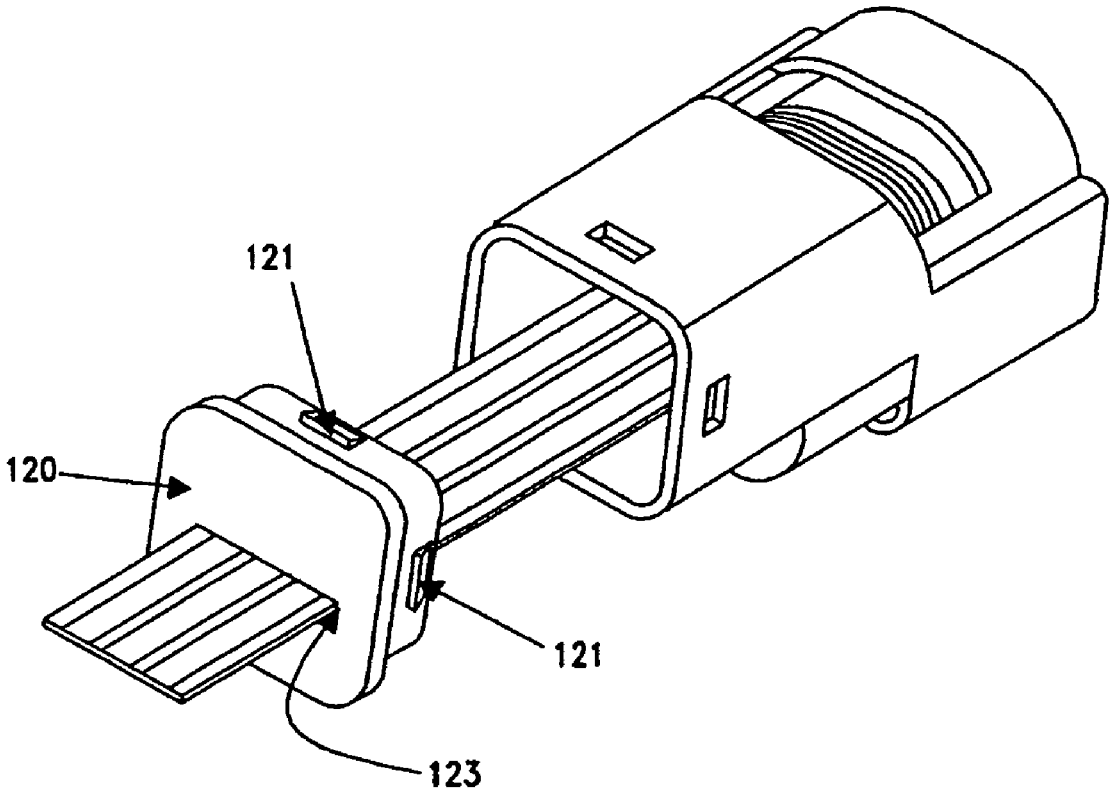

A preferred assembly of the flat cable connector 100 with the flat cable arrangement 200 according to FIG. 9 to 12 is described below. First the flat cable arrangement 200 is guided through the slot 123 of the opening cover 120 and then the terminal 201 are linked by crimping or soldering to the conductors of the flat cable arrangement 200. The flat cable arrangement 200 with the end possessing the terminals 201 is then inserted into the flat cable insertion opening 103, as shown in FIG. 10. If the other end of the flat cable arrangement is freely available and not equipped with terminals, the opening cover 120 can also subsequently be pushed on to the flat cable arrangement in its insertion direction. It is worth pointing out that for the purposes of the subsequent attachment of the opening cover 120 at the flat cable arrangement 200 the opening cover 120 can also e.g. be in one piece with two halves that can be brought together or in two parts, depending on the application.

Thus in this embodiment too essentially the same advantages accrue during the insertion of the flat cable arrangement 200 as in the first embodiment.

Figure 11:
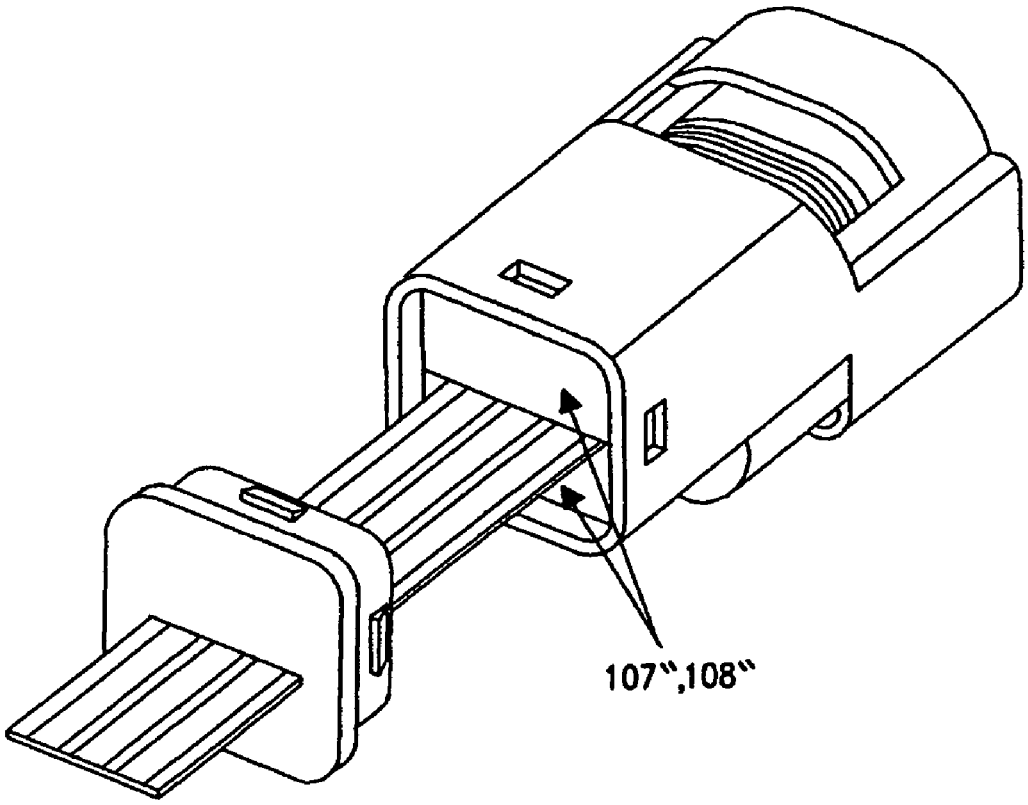
Figure 12:
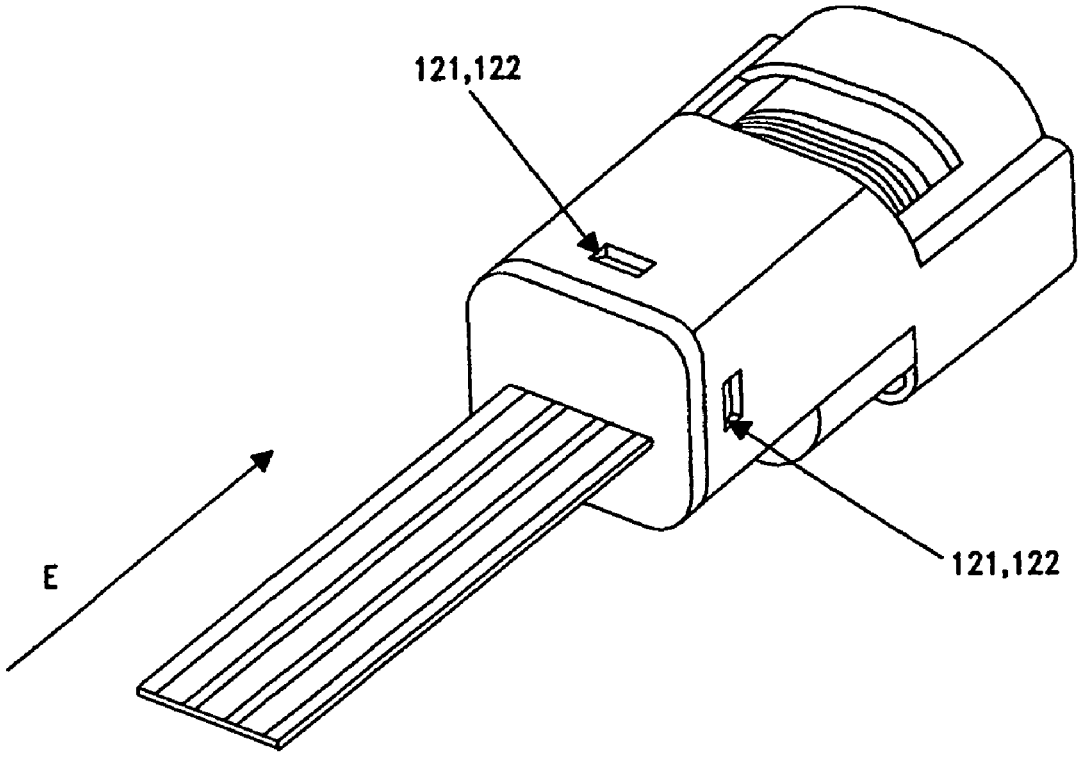

Following the insertion of the flat cable arrangement 200 with the terminals 201 in the desired position the two sealing elements 107" and 108" are inserted above and below the flat cable arrangement in the insertion opening 103, as can be seen in FIG. 11. The sealing elements 107" and 108"are preferably so sized that in this assembled state the outer overall dimension of both sealing elements 107" and 108" combined essentially corresponds to the inner cross-section of the insertion opening 103 and as a result remain in position as a matter of principle. In a next step, represented in FIG. 12, the opening cover 120 is inserted for pressurization purposes in the insertion opening 103 from behind, that is in the insertion direction E of the flat cable arrangement 200, until the complementary catching or snapping devices 121 and 122 engage with each other and fix the opening cover 120 on the flat cable connector 100, preferably by applying pressure, so that in this final position permanent pressure is exercised on the sealing gel by the opening cover 120.

In this embodiment too the insertion opening 103 can be reopened by releasing the interacting catching devices.

What is claimed is:

1. Connector for a sealed connection of a flat cable arrangement, comprising:

an external housing, which even in an unassembled condition of the connector and a flat cable arrangement has an insertion opening which is adapted for the insertion of the end of a flat cable arrangement in order to effect electrical connection at a connection area of the insertion opening, at least two sealing elements comprising compressed gel being arranged at the connection area of the insertion opening for the end of a flat cable arrangement in such a way that they only come into effective contact with the flat cable arrangement when the flat cable arrangement is in an inserted condition;

a pressurization device with which said two sealing elements can be moved in a pincer-like movement in direction of an upper and a lower side of the flat cable arrangement into a position essentially closing the insertion opening when the flat cable arrangement is in an inserted condition; and guidance devices that extend along a side of the insertion opening in the insertion direction of the flat cable arrangement diagonally from above and below the flat cable arrangement in direction to the flat cable arrangement for the simultaneous guidance of the pressurization device in a normal direction in relation to the flat cable device as well as in an axial direction in relation to the flat cable arrangement.

2. Connector according to claim 1, in addition characterized in that the flat cable arrangement comprises a flex foil, a flat ribbon cable, a flexible printed circuit, an extruded cable or a laminated cable.

3. Connector according to claim 1, in addition characterized by, terminal contacts and/or terminal position assurance means arranged at the connection area of the connector for interacting with terminals attached to the conductor ends of the flat cable arrangement.

4. Connector according to claim 1, in addition characterized by the gel being a silicon gel or an elastomer based on gel.

5. Connector according to claim 1, in addition characterized by the gel being a dielectric.

6. Connector according to claim 1, characterized by catching or snapping means associated to the pressurization device at least for the fixation of the pressurization device in the position essentially closing the insertion opening.

7. Connector according to claim 1, in addition characterized in the pressurization device comprising a connector housing cover for closing the insertion opening.

8. Connector according to claim 1, in addition comprising a jacket or plug connector end for connecting a counter connector essentially opposite the insertion opening.

9. Connector according to claim 1, wherein said compressed gel is in the form of a pillow or cushion as a sealing element.

10. Connector according to claim 1, in addition characterized by sealing elements and a pressurization device that can be inserted after the flat cable arrangement has been inserted in the insertion opening.

11. Connector according to claim 10, with the pressurization device in addition having a slot essentially corresponding to the cross-section of the flat cable arrangement and through which the flat cable arrangement is guided.

12. Connector for a sealed connection of a flat cable arrangement, comprising:

an external housing which even in an unassembled condition of the connector and a flat cable arrangement has an insertion opening which is adapted for the insertion of the end of a flat cable arrangement in order to effect electrical connection at a connection area of the insertion opening, at least one sealing element comprising compressed gel being arranged at the connection area of the insertion opening for the end of a flat cable arrangement in such a way that it only comes into effective contact with the flat cable arrangement when the flat cable arrangement is in an inserted condition;

a pressurization device for the pressurization of the at least one sealing element for sealing at least the connection area when the flat cable arrangement is in an inserted condition; and guidance and catching devices associated with said pressurization device to guide it first in a normal direction in relation to the flat cable arrangement at the connection area and then in an axial direction in relation to the flat cable arrangement at the connection area or vice versa.

13. Connector according to claim 12, in addition characterized in the flat cable arrangement in fully assembled state projecting out of the connector housing in relation to the insertion direction of the flat cable arrangement at an angle, preferably in essence of 0°, +90° or −90°.

14. Connector according to claim 12, characterized by a through hole leading outwards through the connector housing at the point of at least one of said sealing elements comprising compressed gel.

* * * * *